United States Patent [19]

Kelch et al.

[11] 4,369,704

[45] Jan. 25, 1983

[54] PRINTING DEVICE FOR DISTANCE COUNTER MECHANISM

[75] Inventors: Heinz Kelch, Königsfeld; Eduard Schuh, Villingen-Schwenningen, both of Fed. Rep. of Germany

[73] Assignee: Kienzle Apparate GmbH, Villingen, Fed. Rep. of Germany

[21] Appl. No.: 212,577

[22] Filed: Dec. 3, 1980

[30] Foreign Application Priority Data

Dec. 13, 1979 [DE] Fed. Rep. of Germany ..... 2950118

[51] Int. Cl.[3] ..... B30B 9/06; B30B 9/00

[52] U.S. Cl. ..... 101/110; 101/90

[58] Field of Search ..... 101/269, 45, 90, 270, 101/35, 56, 110; 400/158

[56] References Cited

U.S. PATENT DOCUMENTS

| | | | |
|---|---|---|---|
| 3,330,207 | 7/1967 | De Man | 101/90 X |
| 3,756,151 | 9/1973 | Zofchak | 101/269 |
| 3,920,113 | 11/1975 | Tamai | 400/158 |
| 4,003,307 | 1/1977 | Sano et al. | 101/45 |

*Primary Examiner*—Richard J. Apley
*Assistant Examiner*—David J. Isabella
*Attorney, Agent, or Firm*—Toren, McGeady and Stanger

[57] ABSTRACT

A printing mechanism, particularly for a counter device which records distances, is formed with a pair of sets of print wheels with a housing defining a slot through which a voucher may be passed to have imprinted thereon information contained on the print wheels. Platens are arranged to press the voucher against the print wheels and platen carriers which are rotatably mounted have the platens eccentrically mounted thereon. Overcenter springs engage the platen carriers, and after the carriers have been rotated through a predetermined angle, the overcenter springs drive the carriers through a further angle of rotation during which the platens are pressed against the print wheels during the printing process. The angle through which the platen carrier is initially rotated to load the overcenter spring is less than the angle through which the platen carrier is driven by the loaded overcenter spring.

4 Claims, 4 Drawing Figures

PRINTING DEVICE FOR DISTANCE COUNTER MECHANISM

The present invention relates generally to printing mechanisms and, more particularly, to a printing device for a distance counter apparatus. The distance counter of the type to which the present invention relates comprises at least two sets of type wheels which are juxtaposed for rotation about parallel axes with at least one of the type wheels being driven as a function of distance with means being provided for simultaneous transfer of the numerical and/or alphanumerical values contained in the sets of type wheels to a voucher.

In the process of imprinting information on a voucher, the printing process can be accomplished either by a striking or rolling motion which involves the interaction between a type carrier and a movable element which cooperates with the fixed type carrier. Both printing techniques involving either a striking or a rolling motion involve advantages and disadvantages. When a hammer-type printing device is utilized, it is possible to achieve relatively short printing pulses and good printing contrast on the one hand. However, there exists a danger of chatter so that the printing quality may be impaired and there may be formed effects such as a shadow formation.

In contrast to this technique, a printing device employing the rolling principle will usually provide a weaker printing contrast but it will avoid the problem of chatter. Since the forces active in such a printing device are generally weaker than in a hammer-type of printing device, the design tends to be less complicated, particularly with respect to wear problems which may arise. On the other hand, considerable sophistication is required for retention of printed matter, i.e., the voucher, during the printing process.

The present invention is considered particularly applicable in arrangements wherein at least two juxtaposed sets of type wheels having parallel axes are used in a counting mechanism for printing distance information wherein space accommodation and voucher size are important from a design viewpoint. In particular, the invention is applicable in devices where two distinguishable types of information are to be furnished by the apparatus. The present invention is particularly intended to avoid the drawbacks of printing devices and, more particularly, it is directed toward the provision of a printing device which is suited to the application involved wherein production and assembly costs may be, to a great extent, minimized.

SUMMARY OF THE INVENTION

Briefly, the present invention may be described as a printing mechanism comprising print wheel means, means for passing sheet means such as a voucher or the like past the print wheel means to effect printing of information thereon, platen means arranged to press the sheet means against the print wheel means during the printing process, platen carrier means having the platen means mounted thereon, and overcenter spring means engaging the platen carrier means to drive the platen means against the print wheel means during the printing operation, said platen carrier means being mounted to be rotated against the overcenter spring means to effect spring loading thereof and to enable the overcenter spring means to then drive the platen carrier means through the printing operation.

In particular, the platen carrier means may be manually rotated through a first angle whereby the overcenter spring means are engaged and spring loaded. After the platen carrier means has traversed the angular position represented by said first angle, the platen carrier means will be in a position whereby as a result of a spring force developed by the overcenter spring means, the platen carrier means will be driven through a second angle during the printing process.

In accordance with the present invention, the first angle is smaller than the second angle.

Thus, in accordance with the invention, a solution to problems encountered with the prior art is provided in that each set of the print wheel means or type wheels will be coordinated with a platen, each platen will be disposed in a rotatably mounted platen carrier eccentric to the latter's axis, the shafts of the type wheel sets and of the platen carriers will be disposed in planes parallel in pairs and perpendicular to each other, and the platen carriers will be interconnected by gear means so that the platens will rotate in opposite directions.

In one preferred embodiment of the invention, at least one of the platen carriers is designed to act in conjunction with a spring loaded lever representing the overcenter spring means. Furthermore, in the preferred example of the invention, a guide roll is disposed at least in the platen carrier interacting with the spring loaded lever. The guide roll axis lies in a plane determined by the axis of the platen and of the platen carrier. The dimension of the radius of the platen plus the center distance between the platen carrier and the platen is arranged to be greater than the dimension of the radius of the guide roll plus the center distance between the platen carrier and the guide roll.

In the preferred embodiment of the invention, there are provided on the platen carriers teeth which will, on the one hand, enable the platen carriers to be driven and flanges which serve, on the other hand, for the mounting of the platen and guide roll shafts.

A particular advantage offered by the present invention arises in that the voucher will be retained clamped between the type wheel sets at the moment of printing due to the rolling action of the platen in opposite directions so that with no additional means required, the printing operation may be successfully performed. At the same time, chatter will be prevented due to the combination of a rolling and striking printing action which is accomplished while at the same time achieving good contrast and print quality in the results obtained.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

and

Figure 4:
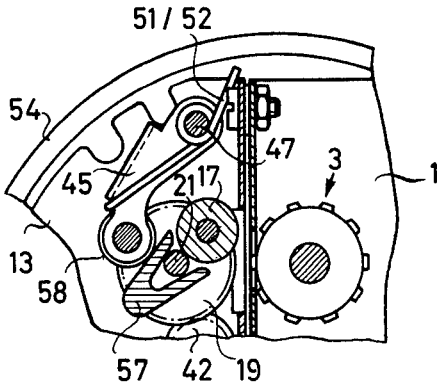

FIG. 4 is a partial sectional view depicting parts of another embodiment of the invention.

DETAILED DESCRIPTION OF THE PREFERRED EMBODIMENTS

Figure 1:
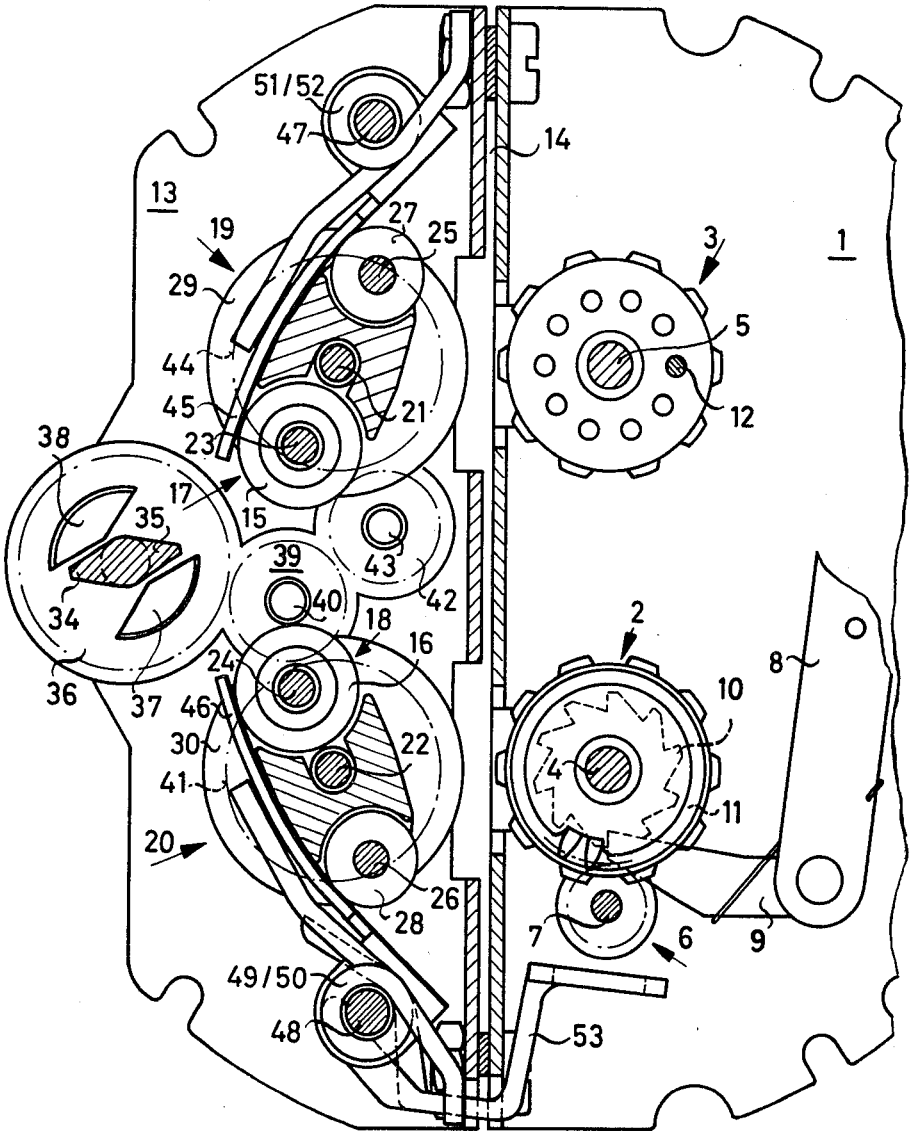
FIG. 1 is a sectional view showing the essential elements of a printing mechanism in accordance with the present invention.

Referring now to the drawings wherein like reference numerals are used to refer to similar parts throughout the various figures thereof, and referring particularly to FIG. 1, an embodiment of the invention is depicted wherein a pair of sets of type wheels 2 and 3 are operatively disposed in a U-shaped frame member 1 in such a manner that the individual type wheels of the type wheel sets 2, 3 are rotatably mounted and arranged independently of each other on shafts 4 and 5 fastened in the frame 1.

The type wheel set 2 is, for example, designed as a distance counting mechanism which is so provided that a set of decimal transfer mechanisms 6 rotatably mounted on another shaft 7 are in engagement with the type wheels in a manner known, per se, and so that a switching lever 8 driven as a function of the distance is actuated and serves, by means of a pawl 9 which is spring mounted thereto, to advance a first type wheel 11 by means of suitable teeth 10 provided thereon. The type wheel set 3 of the present embodiment serves merely to represent a fixed value which means that the individual type wheels freely rotatable are locked by a rod 12 which penetrates all the type wheels eccentrically relative to the shaft 5 after the fixed value has been set.

As may be further seen from FIG. 1, a second U-shaped frame 13 is connected with the frame 1 so that a slot 14 will be formed therebetween. The slot 14 serves as an insertion opening within which there may be provided a voucher, card or the like upon which information may be printed.

As may be further seen, there is coordinated with each type wheel set 2 and 3 a platen 17 and 18, respectively, with the platens being provided with a rubberelastic jacket 15 and 16. The platens are themselves rotatably mounted in platen carriers 19 and 20, each of which are rotatably mounted in the frame 13.

The platen carriers 19 and 20 are mounted upon shafts 21 and 22 which are arranged so that, together with the shafts 4 and 5 of the type wheel sets 2 and 3, they are disposed in planes parallel in pairs.

Figure 2:
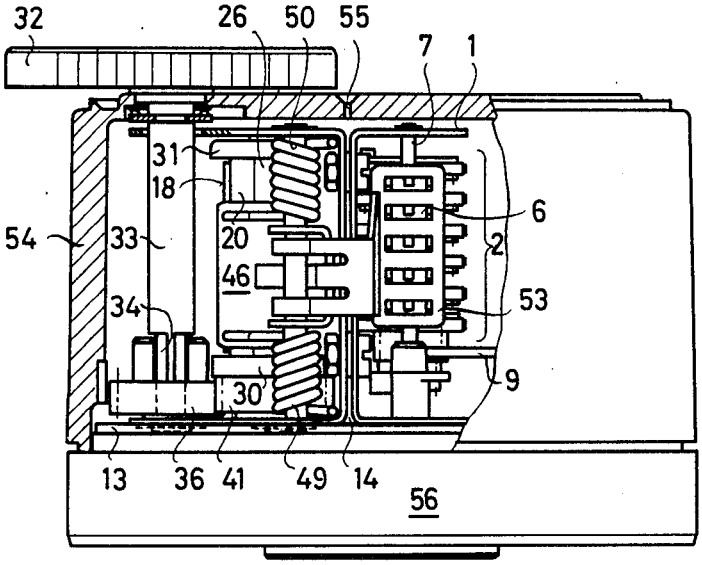
FIG. 2 is a side view of the printing mechanism of the invention.

The platen carriers 19 and 20 are provided with suitable flanges of which one each 29 and 30, respectively, are shown in FIG. 1 and of which an additional flange 31 is shown in FIG. 2, with the flanges being provided to accommodate the shafts 23 and 24 upon which the platens 17 and 18 are mounted. The flanges are provided also for additional shafts 25 and 26 upon which guide rolls 27 and 28 are rotatably mounted.

In the structure and arrangement of the device of the present invention, the platen, the platen carrier, and the guide roll shafts each lie in one plane and the sum of the platen radius plus the center distance between the platen carrier and the platen is greater than the sum of the guide roll radius plus the center distance between the platen carrier and the guide roll.

The dimension between the shafts 21 and 22 of the platen carriers 19 and 20 and the type surface is selected so that jackets 15 and 16 of the platens 17 and 18 will be elastically deformed at the instant when a printing action occurs with no contact taking place between the guide rolls 27 and 28 and the type wheels sets.

The platen carriers 19 and 20 are driven by means of a manually operable knob 32, best seen in FIG. 2. The knob 32 operates to rotate a shaft 33 mounted in the frame 13. Drivers 34 and 35 are located on the opposite end of the shaft 33 and they are arranged in driving engagement with corresponding lugs 37 and 38 provided upon a gear 36 which is rotatably mounted on the shaft 33. The gear 36 meshes with teeth 41 formed on the platen carrier 20 through a first intermediate gear 39 mounted in an overhung position on a shaft 40 fastened in the frame 13. Another intermediate gear 42 also mounted in an overhung position on the shaft 43 fastened in the frame 13 meshes with the first intermediate gear 39 and with teeth 44 formed on the platen 19 whereby the two platen carriers 19 and 20 may be rotated in opposite directions. It should be mentioned for the sake of completeness that the platen carriers 19 and 20 represent parts which are preferably produced by injection molding or die casting techniques and wherein the flanges and teeth mentioned may be molded directly to the actual platen carrier body integrally therewith.

In the detained position of the printing mechanism which is depicted in FIG. 1, an arched lever 45, 46 acts upon the respective platen carriers 19 and 20 with the levers 45, 46 resting upon a respective platen 17, 18 and upon a respective guide roll 27, 28. Of course, the arched levers 45 and 46 may also act upon an appropriately designed portion of the body of the respective platen carriers 19, 20.

The levers 45 and 46 are, in turn, pivotally mounted on shafts 47, 48 disposed in the frame 13 and they are under the influence of torsion springs 49/50 and 51/52, respectively, which are disposed upon the same shafts. A single spring may be used instead of the spring pairs 49/50, 51/52, but this would entail higher production costs.

In addition to the foregoing, an aligning element 53 is also mounted pivotally on the shaft 48 with the aligning element 53 being automatically moved with the printing process when the printing process is triggered, that is, when the lever 46 is pivoted, so that it may be caused to engage the decimal transfer mechanisms 6 thereby aligning the type wheels of the type wheel set 2. FIG. 2 shows, furthermore, that the frames 1 and 13 are disposed in a cupped housing 54 within which a slot 55 is formed coordinated with the slot 14 and being provided with a chassis 56 which encloses the apparatus.

In another embodiment of the invention shown in FIG. 4, the body of a platen carrier is designed as a cam 57 with which a roll 58 mounted to an appropriately designed lever interacts. In this embodiment, however, more space is required than in the embodiment previously described and it offers a less exact detained position.

During the operation of the printing mechanism of the invention previously described, the knob 32 is turned clockwise whereby the drivers 34 and 35 formed on the shaft 33 are rotated into driving connection with the lugs 37 and 38 formed on the gear 36 in accordance with the position shown in FIG. 1. The gear 36 is thereby driven and, hence, by means of the intermediate gears 39 and 42, the platen carriers 19 and 20 are also driven and moved out of their detained position designated I in FIG. 3 in opposite directions.

In the process, the guide rolls 27 and 28 roll off the respective levers 45 and 46 and pivot them counter to the springs 49/50 and 51/52. Accordingly, the levers 45 and 46 will be placed in a spring loaded position by the springs acting thereon, respectively.

Figure 3:
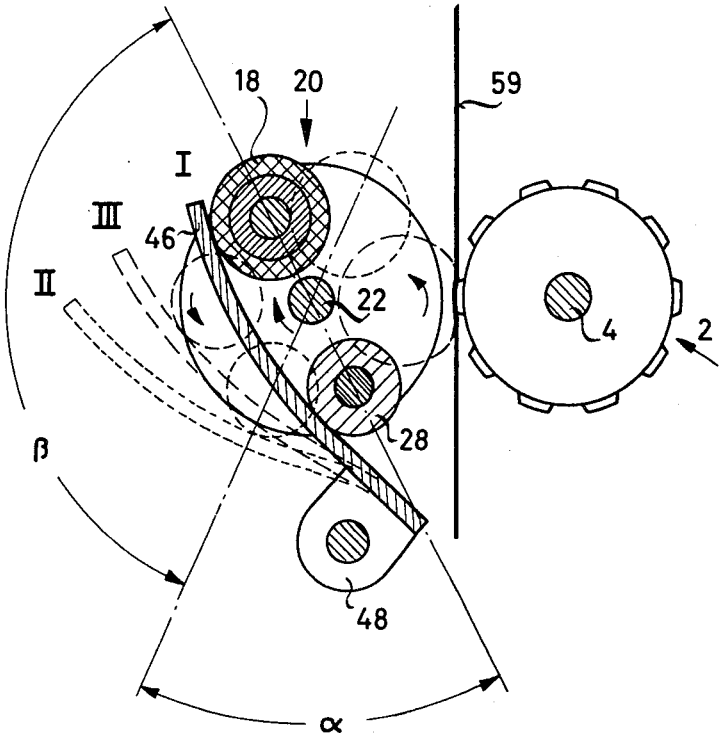
FIG. 3 is a schematic sectional view depicting the essential features of the operating mode of the invention.

When the mechanism reaches the position II shown in FIG. 3, an unstable condition is developed between the lever 46 and the guide roll 28, for example, whereby the platen carrier 20 will automatically continue moving clockwise under the action of the spring 49/50 imparting a driving spring force through the lever 46 until the mechanism reaches the detained position opposite to the position I.

Thus, with reference to FIG. 3, when an overcenter position is reached by virtue of rotation of the platen carrier 20 by operation of the knob 32, the lever 46 will be spring loaded by the action of the springs 49/50 as the platen carrier 20 rotates through an angle $\alpha$ shown in FIG. 3 and when the overcenter position is reached, the lever 46 will tend to move clockwise about the pivot shaft 48, as seen in FIG. 3, thereby driving the platen carrier in continued clockwise rotation as a result of the spring force which is developed. The term "overcenter spring" as used herein is intended to refer to the action of the springs 49/50, 51/52 acting, respectively, upon the platen carriers 20 and 19 through the levers 46, 45 in the manner described above.

In this process, both of the platen carriers 19 and 20, which of course operate similarly, will pass through a printing position III at relatively high speed simultaneously and in opposite directions. Thus, an inserted voucher 59 will be clamped in this manner during the printing operation in opposite direction by the platens acting thereupon and it will thus be retained in position with respect to the type wheel sets 2 and 3. The free wheeling which is required for the automatic advancement of the platen carriers 19 and 20 and which must, in the solution of the problem, not be influenced by knob actuation in the opposite direction, is assured as will be evident from FIG. 1 by an appropriate design of the drivers 34 and 35 and of the lugs 37 and 38. When the knob 32 is again actuated in a clockwise direction, actuation in the opposite direction can be prevented by a suitable locking mechanism and the platen carriers 19, 20 can be returned into their starting positions in that the platens 17 and 18 then roll off the levers 45 and 46 without another reproduction occurring.

It will be apparent that the printing device described may also be designed so that only one platen carrier interacts with a spring loaded lever in which case the spring force must be accordingly higher or differently designed springs must be used.

The decisive factor is that, in the selected arrangement, the angle $\alpha$ through which the platen carriers 19 and 20 are rotated by operation of the knob 32 is selected to be considerably smaller than an angle $\beta$ through which the platen carriers 19 and 20 are drivingly rotated by operation of the spring force previously described. As a result, the platen carriers 19 and 20 are therefore accelerated over an entire range of motion through the angle $\beta$, having already assumed a relatively high speed in the printing position of the platens 17, 18. It will further result that the printing energy will be transmitted by a striking action rather than a rolling action, so that a relatively good print contrast will be obtained. Moreover, due to the effective lever ratios, an exact, stable, detained position of the platen carriers 19 and 20 will be provided in the example of the preferred embodiment of the invention.

While specific embodiments of the invention have been shown and described in detail to illustrate the application of the inventive principles, it will be understood that the invention may be embodied otherwise without departing from such principles.

What is claimed is:

1. A printing mechanism for recorders comprising at least two sets of type wheels juxtaposed relative to each other for rotation about parallel axes, means for enabling transfer of information contained in said type wheels into printed form onto a voucher, platen means coordinated for operation with said type wheel sets, and rotatably mounted platen carrier means having said platen means eccentrically mounted thereon, said type wheel sets and said platen carrier means being rotatable about axes which are disposed in planes parallel in pairs, said platen carrier means being interconnected by gear means such that said platen means rotate in directions opposite to each other, said platen means comprising at least one platen carrier, said mechanism further comprising a spring loaded lever designed to cooperate with said platen carrier, with a guide roll being disposed on at least said platen carrier interacting with said spring loaded lever so that a shaft of said guide roll will lie in a plane determined by shafts of said platen means and of said platen carrier means and wherein the sum of the radius of said platen carrier plus the center distance between said platen carrier and a platen mounted thereon is greater than the sum of the radius of said guide roll plus the center distance between said platen carrier and the guide roll.

2. A printing mechanism comprising print wheel means, means for passing sheet means past said print wheel means to effect printing thereon, platen means arranged to press said sheet means against said print wheel means during said printing, platen carrier means having said platen means mounted thereon and overcenter spring means engaging said platen carrier means to drive said platen means during a printing operation, said platen carrier means being mounted to be rotated against said overcenter spring means to effect spring loading thereof to enable said overcenter spring means to drive said platen carrier means through said printing operation, said platen carrier means being manually rotatable through a first angle to a predetermined angular position in order to spring load said overcenter spring means and with said overcenter spring means, as a result of said spring loading, operating to drive said platen carrier means through a second angle in order to press said platen means against said print wheel means, said first angle being smaller than said second angle.

3. A mechanism according to claim 1 wherein said platen carrier means are formed with gear teeth to enable said platen carrier means to be driven by gear means, said platen carrier means further comprising flanges upon which there are mounted shafts of said platen means and of said guide rolls.

4. A mechanism according to claim 2 wherein said overcenter spring means comprise a spring loaded pivoted lever, wherein said platen means are eccentrically rotatably mounted on said platen carrier means and wherein said spring loading of said overcenter spring means occurs as a result of manual rotation of said platen carrier means in engagement with said spring loaded lever.

* * * * *